US005785550A

United States Patent [19]

Leshem et al.

[11] Patent Number: 5,785,550

[45] Date of Patent: Jul. 28, 1998

[54] TWO-CHANNEL CONNECTOR AND CONNECTION METHOD

[76] Inventors: Eli Leshem, 90 Rawson Rd., Brookline, Mass. 02146; Daniel Castel, 18 Landwood Ave., Framingham, Mass. 01701

[21] Appl. No.: 279,788

[22] Filed: Jul. 25, 1994

[51] Int. Cl.[6] ..... H01R 9/07

[52] U.S. Cl. ..... 439/497

[58] Field of Search ..... 174/117 F, 117 FF; 439/497, 492

[56] References Cited

U.S. PATENT DOCUMENTS

| | | | |
|---|---|---|---|
| 3,447,120 | 5/1969 | Rask et al. | 439/497 |
| 4,149,026 | 4/1979 | Fritz et al. | 174/117 F |
| 4,157,612 | 6/1979 | Rainal | 439/497 |
| 4,988,890 | 1/1991 | Narhi et al. | 439/505 |
| 5,099,137 | 3/1992 | Lattin, Jr. | 307/147 |

*Primary Examiner*—Gary F. Paumen
*Assistant Examiner*—Barry M. L. Standig
*Attorney, Agent, or Firm*—Leanne J. Fitzgerald, Esq.; John M. Gunther, Esq.

[57] ABSTRACT

Two data communication channels having electrical ground positions that alternate with control and data positions are terminated in a single, dual-channel connector that occupies generally the same interconnection board real estate as is required for a single, prior art, data communication SI connector, such as for a Small Computer System Interface (SCSI) communication channels. A two-channel SCSI connector system and connection method includes providing a two-channel header having two ground buses, to which the alternating electrical ground wires of respective first and second SCSI channels are terminated. Only a few of the pins or positions of the two-channel connector are connected to the two ground buses while the majority of pins or positions are connected to the signal (control, data) wires of the two SCSI channels.

8 Claims, 2 Drawing Sheets

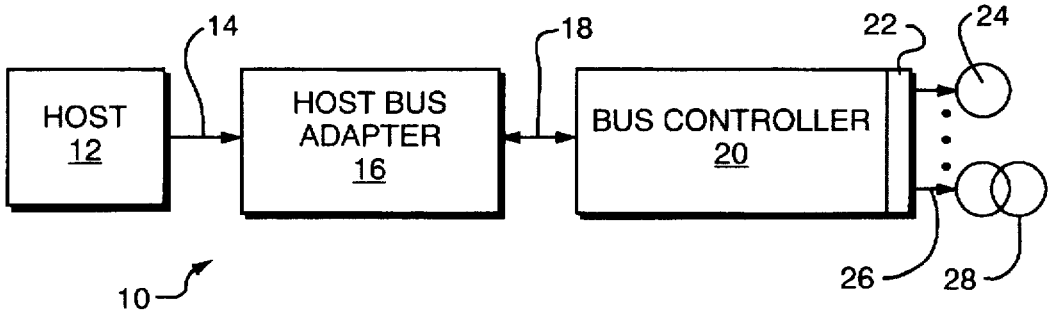
FIG. 1
FIG. 2
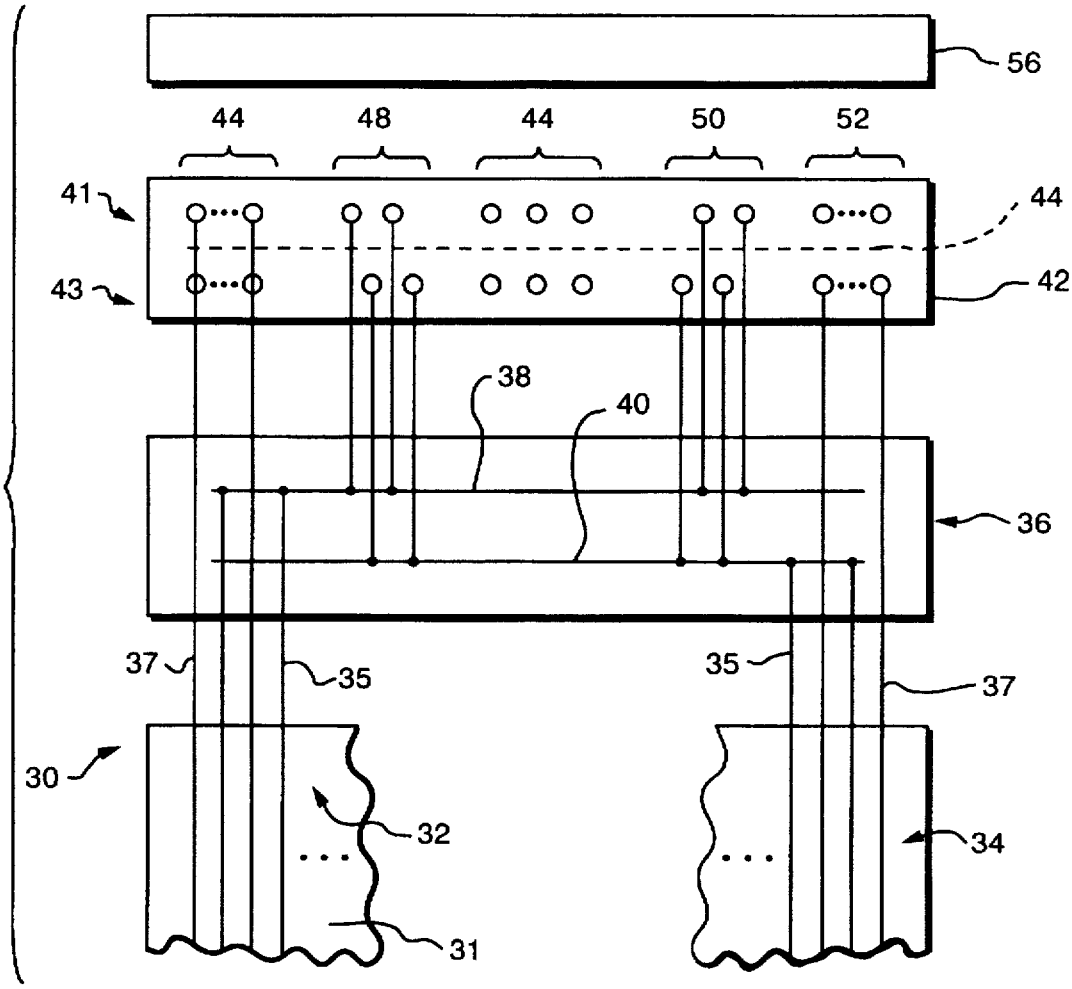

TWO-CHANNEL CONNECTOR AND CONNECTION METHOD

CROSS REFERENCE TO RELATED APPLICATION

This invention is related to co-pending application entitled Two-Channel SCSI-Compatible Interconnect System and Method of the same assignee as herein and filed on even date herewith and identified as Ser. No. 08/279,785 filed Jul. 25, 1994 U.S. Pat. No. 5,577,931.

FIELD OF THE INVENTION

This invention is directed to the field of electrical interconnections, and more particularly, to a novel, two-channel Small Computer System Interface.

BACKGROUND OF THE INVENTION

The small computer system interface (SCSI) is a specification (ANSI standard X3.131-1986) for a peripheral bus and command set that defines a high performance, peripheral interface that distributes data among peripherals independently of the host. SCSI works by masking the internal structure of the peripherals from the host computer and uses an eight-port bus that can accommodate either single or multiple-host systems.

The SCSI interface has a total of eighteen (18) defined signals. Nine (9) are used for control and nine (9) are used for data (eight (8) data lines and one (1) parity line). The data lines are bi-directional and transfer data, commands, status and message information. The control signals and the bus phases determine when and in what direction data is transferred.

The SCSI bus supports two electrical specifications, so-called single-ended and differential. The single-ended version uses TTL voltage levels (0–5 volts), while the differential uses EIA RS-485 signals (+12 v to −12 v) to allow the use of longer cables. The present invention is particularly well suited for the single-ended electrical specification.

Typical SCSI cable and connector systems are generally made up of fifty (50) lines, of which, as mentioned, nine (9) are data signals (including parity) and nine (9) are control signals. The following table contains the pin assignments for the single-ended signals. For the single-ended signals, all odd numbered lines plus the lines numbered twenty (20) twenty-two (22), twenty-four (24), twenty-eight (28), thirty (30), and thirty-four (34) are connected to ground on the controller and pin twenty-five (25) is left open.

TABLE I

| Pin | Mnemonic | Signal | Driven By |
|---|---|---|---|
| 2 | -DB0 | Data Bus Line 0 | Initiator/Target |
| 4 | -DP1 | Data Bus Line 1 | Initiator/Target |
| 6 | -DB2 | Data Bus Line 2 | Initiator/Target |
| 8 | -DB3 | Data Bus Line 3 | Initiator/Target |
| 10 | -DB4 | Data Bus Line 4 | Initiator/Target |
| 12 | -DB5 | Data Bus Line 5 | Initiator/Target |
| 14 | -DB6 | Data Bus Line 6 | Initiator/Target |
| 16 | -DB7 | Data Bus Line 7 | Initiator/Target |
| 18 | -DBP | Data Bus Parity | Initiator/Target |
| 26 | -TERMPWR | Terminator Power | Any device |
| 32 | -ATN | Attention | Initiator |
| 36 | -BSY | Busy | Initiator/Target |
| 38 | -ACK | Acknowledge | Initiator |
| 40 | -RST | Reset | Any device |

TABLE I-continued

| Pin | Mnemonic | Signal | Driven By |
|---|---|---|---|
| 42 | -MSG | Message | Target |
| 44 | -SEL | Select | Initiator/Target |
| 46 | -C/D | Control/Data | Target |
| 48 | -REQ | Request | Target |
| 50 | -I/O | Input/Output | Target |

A typical single-channel SCSI cable and connector system of the prior art is comprised by a flat ribbon cable of fifty (50) wires in width. The flat ribbon cable is typically enclosed in a low-cost insulator, such as poly vinyl chloride (PVC). Accordingly, every other wire of the fifty (50) wire flat ribbon cable is connected to ground to eliminate cross-talk between the other wires that carry the data and control signals. The fifty (50) wire flat ribbon cable is terminated on each of its ends in a two (2) row by twenty-five (25) pin connector. The pins or elements of the SCSI cable connectors are spaced apart from each other in a given row on one hundred thousandths (0.100) inch spacings. Each of the pins of the two (2) row by twenty-five (25) pin SCSI cable connectors are preassigned one of the different single-ended SCSI bus signals as defined in the table above.

The SCSI bus can communicate on one end with one or more host computers and on the other end with up to eight (8) peripheral devices. If the host is internally SCSI compatible, an SCSI bus controller may be directly connected to the host. Otherwise, a host adapter may be provided between the one or more host computers and the SCSI bus to provide the interface between SCSI protocol on one end, and a host computer interface on the other end. To adapt the peripherals to the SCSI bus, a SCSI bus controller is used. The controller communicates the SCSI protocol on one end and communicates with the peripherals on the other end.

The SCSI bus controller typically includes an interconnection board having a plurality of connectors. One (1), two (2) row by twenty-five (25) pin SCSI cable connector is generally required for each of the peripherals to be controlled by the SCSI bus controller. A two (2) row by thirty-two (32) pin connector is required for the recently defined "wide" thirty-two (32) bit SCSU interface. In many large computer systems, thirty-two (32) SCSI buses are employed to connect one hundred twenty-eight (128) peripherals such as disk drives to the host computer. Since each SCSI bus or cable requires a corresponding dedicated connector on the bus controller interconnection board, (thus 32 connectors) it is desirable to provide a means and method for reducing the number of SCSI connectors required to support an array of SCSI peripherals, thereby greatly reducing the amount of board space ("real estate") required to support such a large number of connectors.

SUMMARY OF THE INVENTION

It is accordingly the principal object of the present invention to provide an interconnection system and method that enables nearly double the channel carrying capacity in the same given area of an interconnection board for an interconnection type such as a Small Computer System Interface (SCSI).

Accordingly, apparatus and method are disclosed for terminating in a single SCSI connector header element the alternating ground wires of two (2) SCSI type flat ribbon cables to first and second ground buses internal to the single connector header element.

In accordance with another object of the present invention, an interconnection system and method are disclosed for assigning to each of the first and second ground buses internal to the single connector header element, a connection to at least one connector pin in a dual channel connector. The present invention further discloses a system whereby the control and data wires of the two (2) SCSI flat ribbon cables are respectively assigned to different connector rows of the dual channel connector.

In the preferred embodiment, at least four (4) connector pins or positions for each channel are assigned to provide the ground connection for each internal ground bus to which the ground wires of each respective two (2) SCSI flat ribbon cables are connected, while the control and data wires of the two (2) SCSI flat ribbon cables are assigned to the remaining connector pins of a two (2) row by twenty-five (25) or thirty-two (32) position dual channel SCSI connector. In this manner, a single two (2) row by twenty-five (25) or thirty-two (32) position SCSI connector is able to support two (2) SCSI channels.

In the preferred embodiment of the standard 16 bit SCSI protocol, eight (8) connector pins or ports of the two (2) row by twenty-five (25) position dual channel connectors are dedicated to ground, four (4) per channel; eighteen (18) connector pins are dedicated to the signal wires (control, data) of the two (2) flat ribbon SCSI channels, nine (9) per channel; while three (3) connector pins per channel are available to be assigned or reserved for special signal carrying capability. In one embodiment, at least one end of each of two (2) SCSI flat ribbon cables is not connected to one two (2) row by twenty-five (25) position dual channel connector but rather, are each individually connected to a separate two (2) row by twenty-five (25) position connector, while in another embodiment, the other ends may be connected to a single two (2) row by twenty-five (25) position connector.

BRIEF DESCRIPTION OF THE DRAWINGS

Other objects, features and advantages of the present invention will become apparent by reference to the following detailed description of the preferred embodiment and to the drawings, wherein:

FIG. 1 is a block diagram illustrating the environment of the two-channel SCSI connector system and method of the present invention;

FIG. 2 is a circuit diagram illustrating the two-channel SCSI channel connector and method of the present invention;

DETAILED DESCRIPTION OF THE PREFERRED EMBODIMENTS

Figure 3:
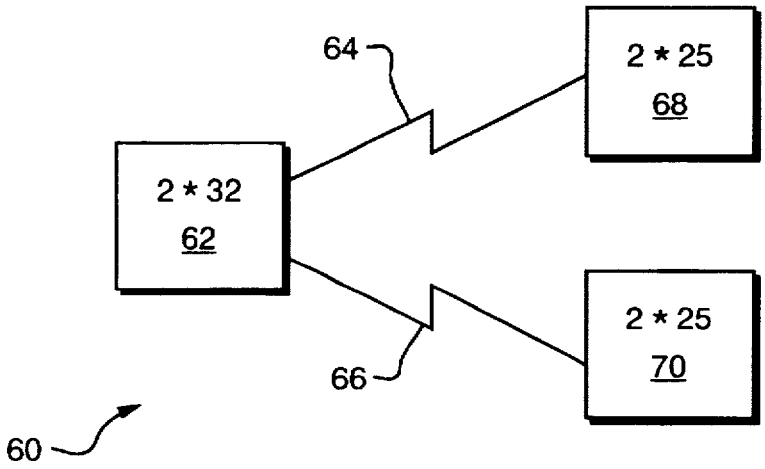
FIG. 3 is a block diagram illustrating one embodiment of the two-channel of the SCSI connector and method of the present invention.

Referring now to FIG. 1, generally designated at 10 is a block diagram of a typical environment of the two-channel SCSI compatible interconnection system and method of the present invention. At least one host computer system 12 having a host bus 14 is connected to a SCSI bus controller 20. The connection to the SCSI bus controller 20 may be made through a host bus adapter 16 and host bus adapter bus 18 in the event that the host and/or host bus 14 are not compatible with the SCSI bus controller 20. One or more peripherals 24,28 are connected via respective SCSI cables and connectors 26 to a SCSI interconnection region 22 on the SCSI bus controller 20.

The SCSI cable wire and connectors 24, each in a single-ended configuration, typically include a flat ribbon cable that terminates in a connector that plugs into a mating connector on the interconnection region of the bus controller 20. The SCSI cable wire and connectors 24 of the present invention enable two (2) SCSI channels to be supported at the interconnection region where the prior SCSI connectors only supported a single channel, thereby effectively doubling the SCSI channel handling capability in the same physical space.

Referring now to FIG. 2, generally designated at 30 is a schematic diagram of the novel two-channel SCSI connector and method in accord with the present invention. A first SCSI cable generally designated 32 having fifty (50) wires and a second SCSI cable generally designated 34 having fifty (50) wires are illustrated. Each of the fifty (50) wires of the two SCSI cables 32, 34 is arranged such that a signal ground wire 35 alternates between signal carrying (control, data) wires 37 in the two cables to eliminate cross-talk. The fifty (50) wires of the two (2) flat ribbon cables 32, 34 are respectively embedded in an insulator material 31, such as poly-vinyl chloride (PVC).

A single connector header element generally designated 36 is provided having two internal ground buses 38, 40. The ground wires of the first flat ribbon cable 32 are terminated in common to the ground bus 38 of the header 36, while the ground wires of the second flat ribbon cable 34 are terminated to the bus 40 of the header 36. The single connector header element 36 may be hard-wired, or may be a connector having insulation displacing contacts commercially available from AUGAT although any other suitable connector element providing one or more internal ground bus is considered within the scope of the present invention.

A two (2) row by twenty-five (25) pin or position connector member 42 having connection ports or positions that are illustrated by circles is mounted to and connected with the single connector header element 36. The header 36 and member 42 may be either integrally formed in one unit, or formed as mating modules. The connector pins are preassigned by rows into first and second SCSI channels 41, 43 that are separated by a dashed line 44. For each SCSI channel, the pins of the connector 42 are preassigned into a group of data pins, as illustrated by a bracket 43, a group of first ground pins and a group of second ground pins, as illustrated by respective brackets 48, 50, a group of control ports, as illustrated by a bracket 52, and a group of special signal ports, as illustrated by a bracket 54. It should be understood that the various groupings of pins may be redefined and changed, all without departing from the present invention.

In an exemplary system, the alternating ground wires of the fifty (50) wire flat ribbon SCSI cable connector 32 are connected to the common ground bus 38 of the header 36 and the alternating ground wires of the fifty (50) wire flat ribbon SCSI cable connector 34 are connected to the common ground bus 40 of the header 36. The ground ports 48 of the channel above dashed line 44 (the first SCSI channel) of the connector 42 are connected to the bus 38 of the header 36, and the ground ports 50 of the second SCSI channel (below dashed line 44) of the connector 42 are connected to the ground bus 40 of the header 36.

The alternating signal carrying wires (control, data) of the fifty (50) wire flat ribbon SCSI cable 32 are connected to a different one of the control positions 52 and data positions 43 of the first SCSI channel 41 above dashed line 44 of the connector 42. The alternating signal carrying wires (control, data) of the fifty (50) wire flat ribbon SCSI cable connector 34 are connected to individual ones of the data positions 44 and control positions 52 of the second SCSI channel 43 below dashed line 44 of the connector 42. The six ports 54 that provide special functionality may be used for any preassigned purpose so long as wires therefor are provided in the flat ribbon cables 32, 34. Any suitable assignment of connector positions into first and second channels may be made without departing from the present invention.

The two (2) row by twenty-five (25) position connector 42 is plugged into a mating connector 56 provided therefor on the interconnection board 22 (FIG. 1) on the bus controller 20 (FIG. 1). The connector 42 thereby provides a two-channel SCSI interface to the connector 56 whose footprint is the same as the heretofore known two (2) row by twenty-five (25) pin single-channel SCSI connector, thereby doubling the SCSI channel carrying capacity of a given area of interconnection board real estate.

Referring now to FIG. 3, generally designated at 60 is a block diagram illustrating one embodiment by which a two-channel SCSI connector 62 of the present invention may be terminated. As shown therein, attached to the ends of two (2) flat ribbon fifty (50) wire cable connectors 64, 66 remote from the two (2) row by twenty-five (25) position connector 62 are conventional two (2) row by twenty-five (25) position connectors 68, 70. The connectors 68, 70 allow connection to physically separated peripheral devices.

Figure 4:
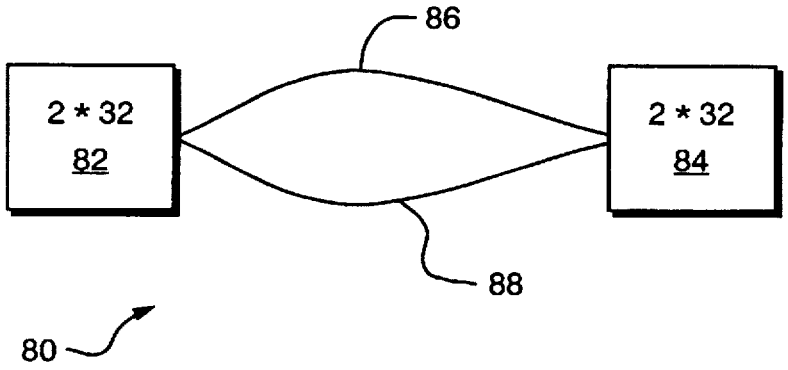
FIG. 4 is a block diagram illustrating another embodiment of the two-channel SCSI connector and method of the present invention.

Referring now to FIG. 4, generally designated at 80 is a block diagram of another embodiment by which a two-channel SCSI connector 82 of the invention may be terminated. As shown therein, attached to the ends of two (2) sixty-four (64) wire flat ribbon SCSI cable connectors 86, 88 remote from the single two (2) row by thirty-two (32) position connectors 82 is another two (2) row by thirty-two (32) position SCSI channel connector 84. The second two-channel SCSI connector 84 enables the connection of two SCSI devices located at the same physical location.

In other contemplated embodiments, woven flat ribbon cable may also be utilized.

Modifications and substitutions by one of ordinary skill in the art are considered to be within the scope of the present invention which is not to be limited except by the claims which follow.

What is claimed is:

1. An interconnection system, for increasing the channel carrying capacity of an interconnection board, comprising:

a first data communication cable carrying at least one data communication channel and having a plurality of pairs of adjacent wires, each pair of adjacent wires alternatively providing a ground signal and one of a data and control signal;

a second data communication cable carrying at least one data communication channel and having a plurality of pairs of adjacent wires, each pair of adjacent wires alternatingly providing a ground signal and one of a data and control signal;

at least one dual communication channel connector header, coupled to an end of each of said first and second data communication cables, said at least one dual communication channel connector header including first and second signal ground buses, wherein said ground signal wires of said first data communication cable are coupled to said first signal ground bus, and said ground signal wires of said second data communication cable are coupled to said second signal ground bus; and at least one dual data communication channel connector element, coupled to said at least one dual communication channel connector header, including first and second signal data communication channel ports, each of said first and second signal data communication channel ports including a plurality of connector positions, wherein each one of said data and control signals of said first signal data communication channel is coupled to a corresponding connector position of said first signal data communication channel port positions, and at least one of said first signal data communication port connector positions is coupled to said first signal ground bus, while each one of said one of data and control signals of said second signal data communication channel are coupled to a corresponding connector position of said second signal data communication channel port positions and at least one of said second signal communication channel port positions is coupled to said second signal ground bus.

2. The interconnection system of claim 1, wherein said first and second single data communication channels include first and second Small Computer System Interface (SCSI) communication channels.

3. The interconnection system of claim 1, wherein said first and second communication channels couple peripheral devices to said interconnection board.

4. The interconnection system of claim 3, wherein said peripheral devices include disk drives.

5. The interconnection system of claim 1, wherein said first and second signal ground buses are coupled to a plurality of connector positions of said respective first and second signal data communication channel ports of said at least one dual data communication channel connector element.

6. The interconnection system of claim 1, wherein said dual channel connector element includes a two (2) row by thirty-two (32) position connector element and, wherein each row of said two (2) row by thirty-two (32) position connector element corresponds to one of said first and second connector element channel port.

7. The interconnection system of claim 6, wherein said first and second single data communication channel cables include a fifty (50) position flat ribbon cable.

8. A method of interconnecting at least first and second communication channels to a single dual communication channel connector element, comprising the steps of:

providing a first signal data communication channel cable, said first signal data communication channel cable having a plurality of pairs of adjacent wires, each pair of adjacent wires alternatingly providing a ground signal, a data and control signal;

providing a second signal data communication channel cable, said second signal data communication channel cable having a plurality of pairs of adjacent wires, each pair of adjacent wires alternatingly providing a ground signal, a data and control signal;

providing at least one dual data communication channel connector header, said at least one dual data communication channel connector header, coupled to at least an end of each of said first and second data communication channel cables, said at least one dual data communication channel connector header including first and second signal ground buses, wherein said ground signal wires of said first data signal data communication channel are coupled to said first signal ground bus; and said ground signal wires of said second signal data communication cable are coupled to said second signal ground bus;

providing at least one dual data communication channel connector element, said at least one dual data communication channel connector element, coupled to said at least one dual data communication channel connector header, including first and second signal data communication channel ports, each of said first and second signal data communication channel ports including a plurality of connector positions, wherein each of said one of data and control signals of said first signal data communication channel are coupled to a corresponding connector position of said first signal data communication channel port positions, and at least one of said first signal data communication port connector positions is coupled to said first signal ground bus, while each of said one of data and central signals of said second signal data communication channel are coupled to a corresponding connector position of said second signal data communication channel port positions and at least one of said second signal communication channel port positions is coupled to said second signal ground bus.

* * * * *

UNITED STATES PATENT AND TRADEMARK OFFICE

CERTIFICATE OF CORRECTION

PATENT NO. : 5,785,550

DATED : July 28, 1998

INVENTOR(S) : Eli Leshem and Daniel Castel

It is certified that error appears in the above-identified patent and that said Letters Patent are hereby corrected as shown below: On the title page: Item [73]

Assignee: EMC Corporation, Hopkinton, MA 01748

Signed and Sealed this

Third Day of April, 2001

*Attest:*

Nicholas P. Godici

NICHOLAS P. GODICI

*Attesting Officer*

*Acting Director of the United States Patent and Trademark Office*